US006564610B2

(12) United States Patent
Lefavour et al.

(10) Patent No.: US 6,564,610 B2
(45) Date of Patent: May 20, 2003

(54) HYDRAULIC TOOL HAVING MECHANICAL ACTUATOR WITH INTERNAL BYPASS VALVE

(75) Inventors: John David Lefavour, Litchfield, NH (US); Armand Thomas Montminy, Manchester, NH (US)

(73) Assignee: FCI USA, Inc., Etters, PA (US)

( * ) Notice: Subject to any disclaimer, the term of this patent is extended or adjusted under 35 U.S.C. 154(b) by 27 days.

(21) Appl. No.: 09/883,549

(22) Filed: Jun. 18, 2001

(65) Prior Publication Data

US 2003/0041644 A1 Mar. 6, 2003

(51) Int. Cl.[7] ..... B21J 9/12

(52) U.S. Cl. ..... 72/453.16; 72/453.07; 60/477

(58) Field of Search ..... 72/453.02, 453.06, 72/453.07, 453.16; 60/477, 480, 481

(56) References Cited

U.S. PATENT DOCUMENTS 4,339,942 A * 7/1982 Svensson ..... 72/453.16
4,942,757 A 7/1990 Pecora ..... 72/453.16
4,947,672 A 8/1990 Pecora et al. ..... 72/453.16
5,284,044 A * 2/1994 Bier ..... 72/453.07
5,979,215 A 11/1999 Lefavour et al. ..... 72/453.16

* cited by examiner

*Primary Examiner*—Lowell A. Larson
(74) *Attorney, Agent, or Firm*—Harrington & Smith, LLP

(57) ABSTRACT

A hydraulic compression tool having a frame, a hydraulic fluid reservoir on the frame, a ram movably connected to the frame, a conduit system in the frame between the reservoir and the ram, a pump provided in the conduit system, a mechanical actuator provided in the conduit system for contacting the ram, and a bypass valve in the conduit system between a rear end of the ram and a channel of the conduit system to the rear end of the mechanical actuator. The conduit system is adapted to conduit fluid from, the pump against both the rear end of the ram and a rear end of the mechanical actuator. The bypass valve is located, at least partially, in a housing member of the mechanical actuator.

24 Claims, 6 Drawing Sheets

HYDRAULIC TOOL HAVING MECHANICAL ACTUATOR WITH INTERNAL BYPASS VALVE

BACKGROUND OF THE INVENTION

1. Field of the Invention

The present invention relates to hydraulic tools and, more particularly, to a hydraulic tool having a mechanical actuator.

2. Brief Description of Prior Developments

U.S. Pat. No. 5,979,215 discloses a hydraulic compression tool with a rapid ram advance. The tool comprises a mechanical actuator which can directly push against a rear end of a ram. The ram is separately movable relative to the mechanical actuator. A bypass valve is provided in the conduit system of the tool to allow hydraulic fluid to bypass the mechanical actuator. The bypass valve is located spaced from the mechanical actuator.

There is a desire to provide a hydraulic compression tool which has additional space within its main body, but without increasing the size of the main body. There is also a desire to permit a bypass valve for a hydraulic compression tool to be relatively precisely adjusted external to the tool. There is also a desire to provide a hydraulic compression tool bypass valve as a subassembly. There is also a desire to reduce complexity of the hydraulic conduit system in the main body of a hydraulic compression tool.

SUMMARY OF THE INVENTION

In accordance with one aspect of the present invention, a hydraulic compression tool is provided having a frame, a hydraulic fluid reservoir on the frame, a ram movably connected to the frame, a conduit system in the frame between the reservoir and the ram, a pump provided in the conduit system, a mechanical actuator provided in the conduit system for contacting the ram, and a bypass valve in the conduit system between a rear end of the ram and a channel of the conduit system to the rear end of the mechanical actuator. The conduit system is adapted to conduit fluid from the pump against both the rear end of the ram and a rear end of the mechanical actuator. The bypass valve is located, at least partially, in a housing member of the mechanical actuator.

In accordance with another aspect of the present invention, a hydraulic compression tool mechanical actuator is provided including a housing member and a bypass valve. The housing member has a front end adapted to push against a hydraulic compression tool movable ram, a rear end hydraulic fluid pushing surface, and a hydraulic fluid conduit channel through the housing member. The bypass valve member is connected to the housing member at the conduit channel.

In accordance with another aspect of the present invention, a hydraulic compression tool is provided having a frame, a hydraulic fluid reservoir on the frame, a ram movably connected to the frame, a conduit system in the frame between the reservoir and the ram, a pump provided in the conduit system, and a mechanical actuator provided in the conduit system for contacting the ram. The conduit system is adapted to conduit fluid from the pump against both the ram and the mechanical actuator. The conduit system comprises a single hydraulic fluid suction line extending from the reservoir. Hydraulic fluid from the reservoir is deliverable through the single suction line directly to the ram through a check valve and, to the mechanical actuator through the pump.

In accordance with one method of the present invention, a method of manufacturing a hydraulic compression tool is provided comprising steps of providing a mechanical actuator assembly, the mechanical actuator assembly having a housing member with a hydraulic fluid channel therethrough, and a bypass valve located in the housing member at the channel; connecting the mechanical actuator assembly to a frame of the tool, the frame including a conduit system, the housing member of the mechanical actuator assembly being slidingly located in a portion of the conduit system; and connecting a ram to the frame. The ram is movable on the frame and is adapted to be directly contacted by the mechanical actuator assembly. The ram is movable relative to the housing member of the mechanical actuator assembly.

In accordance with another method of the present invention, a method of advancing a ram in a hydraulic compression tool is provided comprising steps of actuating a pump of the tool to move the ram relative to a frame of the tool at a first rate of movement by pushing hydraulic fluid against a first pushing surface of a mechanical actuator to push the ram forward, the mechanical actuator being located against the ram; and actuating the pump to move the ram relative to the frame at a second slower rate of movement by pushing hydraulic fluid against a second larger pushing surface of the ram to push the ram forward. The mechanical actuator has a conduit channel with a bypass valve therein. The step of actuating the pump of the tool to move the ram relative to the frame at the second lower rate of movement includes hydraulic fluid passing through the conduit channel and the bypass valve of the mechanical actuator to the second larger pushing surface of the ram.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
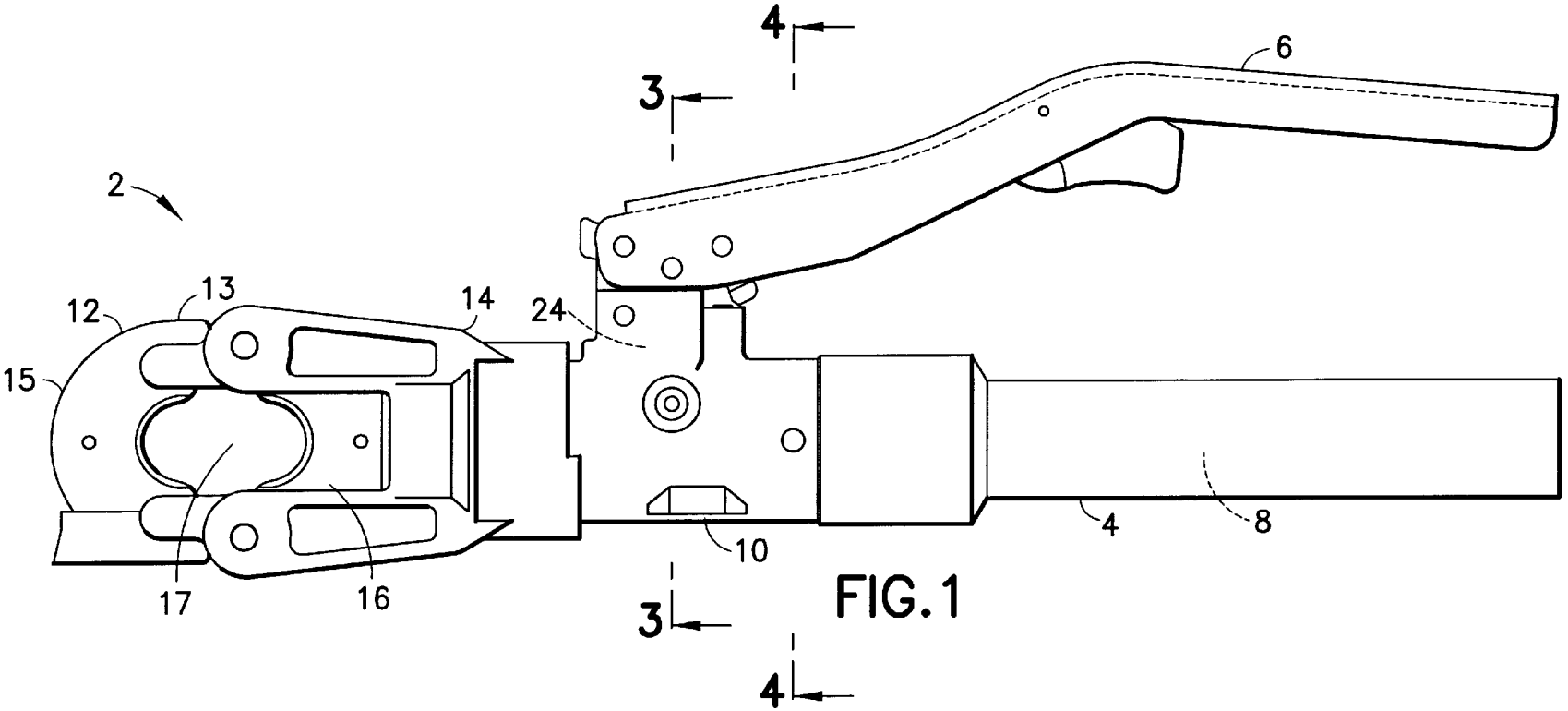
FIG. 1 is a side elevational view of a hydraulic compression tool incorporating features of the present invention.

Referring to FIG. 1, there is shown a side elevational view of a hydraulic compression tool 2 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The tool 2 generally comprises a first handle 4 having a fluid reservoir 8 therein, a second handle 6, a body 10 and a compression head 12. The reservoir 8 is generally capable of holding a supply of hydraulic fluid, such as oil, and capable of supplying the fluid to the body 10. In the embodiment shown, the reservoir 8 is partially formed from a portion of the body 10. The second handle 6 is pivotably mounted to the body 10 for operating a hydraulic pump 24. The tool 2 is similar to the tools shown in the U.S. Pat. No. 5,979,215, which is hereby incorporated by reference in its entirety. U.S. Pat. Nos. 4,942,757 and 4,947,672 also disclosed hydraulic tools with movable rams and are hereby incorporated by reference in their entireties.

The compression head 12 generally comprises a cylinder body 14 with a ram or piston 16 movably mounted therein and a frame 13 with an anvil or clamping section 15. The clamping section 15 and the ram 16 each also comprises means for mounting two dies (not shown) for compressing articles (such as metal electrical connectors) onto elements (such as electrical wires or cables). These dies are removable from the compression head 12 such that the compression head can accommodate different types of dies for different connectors. However, in an alternate embodiment, the compression tool might be a die-less tool. In addition, features of the present invention could be used in any suitable type of hydraulic tool, such as a cutting tool, or a battery powered hydraulic tool.

Figure 2:
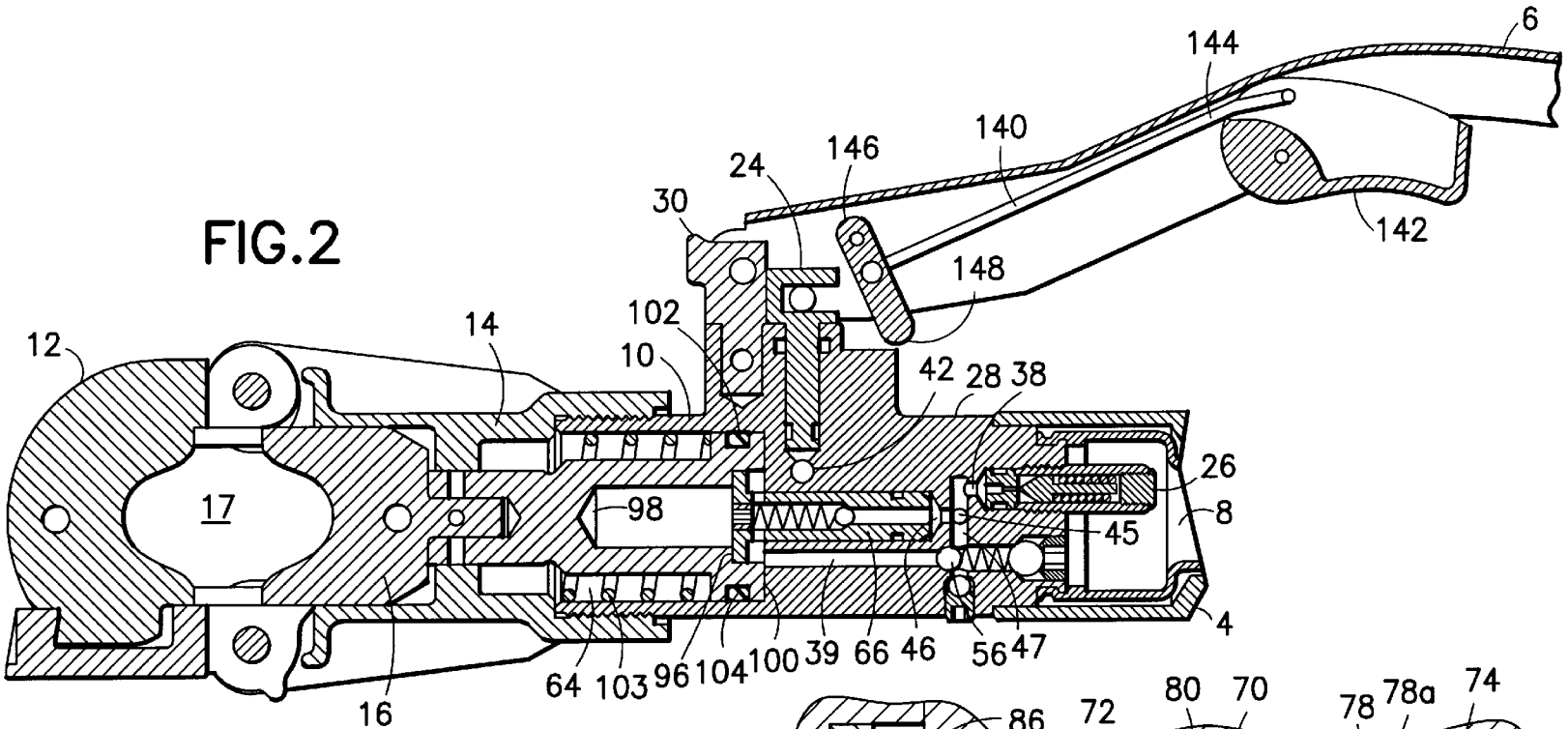
FIG. 2 is a partial cross sectional view of the tool shown in FIG. 1.

The handles 4,6 can be manipulated to operate the hydraulic pump 24 for providing fluid from the fluid reservoir 8 in the first handle 4 to provide high pressure hydraulics to move the ram 16 forward relative to the body 10. Referring also to FIG. 2, the body 10 generally comprises a frame 28, the hydraulic pump 24, a relief valve 26, a release valve 32 (see FIG. 5), and a plurality of conduits forming a supply conduit system and a return conduit system as will be described below. The frame 28 has a pivot arm 30 which is provided for pivotably connecting the second handle 6 to the body 10.

Referring now to all the figures, the conduit system generally comprises a suction conduit 34 (see FIG. 6), return conduits 38–40 (see FIGS. 2 and 5), supply conduits 42–45 (see FIGS. 2–5) and an actuator conduit 46 (see FIG. 2). Conduit 47 functions both as part of the supply and return systems. As seen best in FIGS. 3 and 6, the suction conduit 34 has sections 34*a*, 34*b*, 34*c* and 34*d*. A check valve 52 is located in section 34*b* between sections 34*a*, and 34*d*. A check valve 54 is located at the end of section 34*c*. A hydraulic fluid filter 53 is located at the start of the suction conduit 34 at the reservoir 8.

Figure 4:
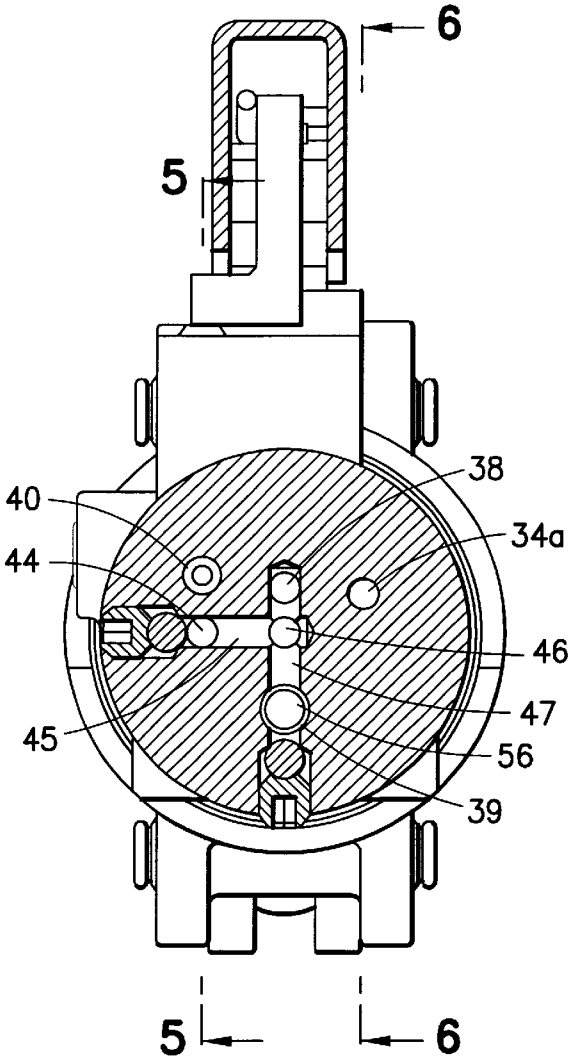
FIG. 4 is a cross sectional view of the tool shown in FIG. 1 taken along line 4—4.
Figure 3:
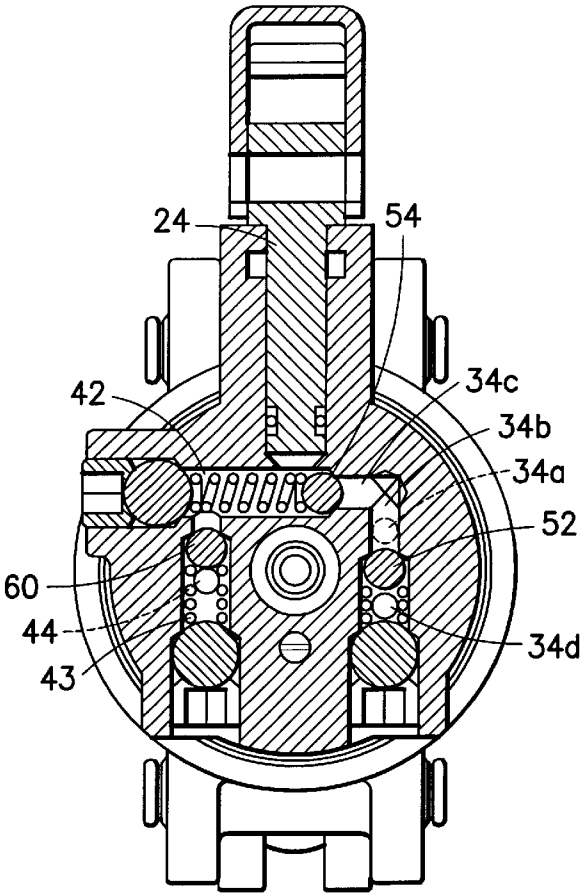
FIG. 3 is a cross sectional view of the tool shown in FIG. 1 taken along line 3—3.
Figure 5:
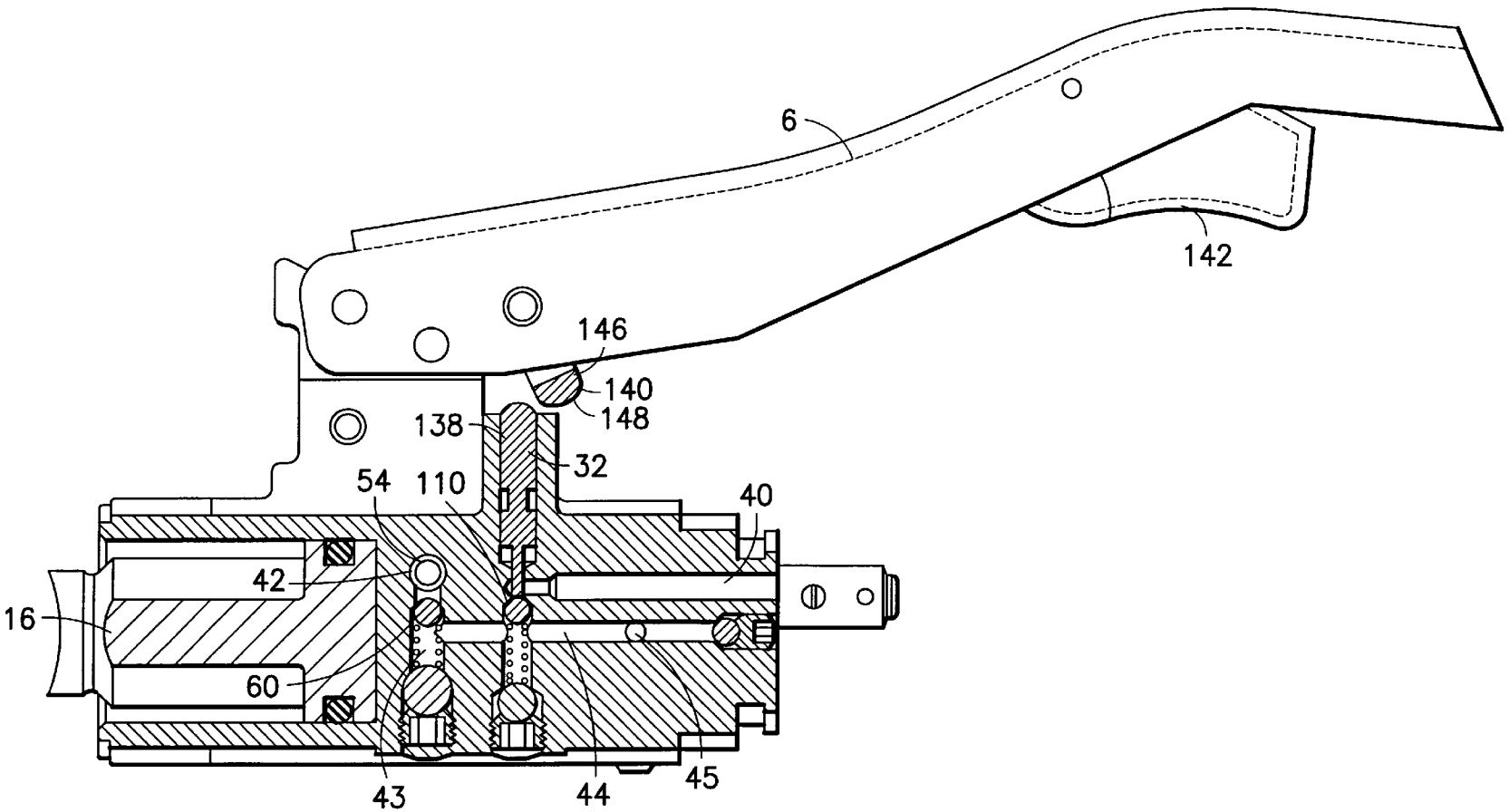
FIG. 5 is a cross sectional view of the tool shown in FIG. 4 taken along line 5—5.
Figure 6:
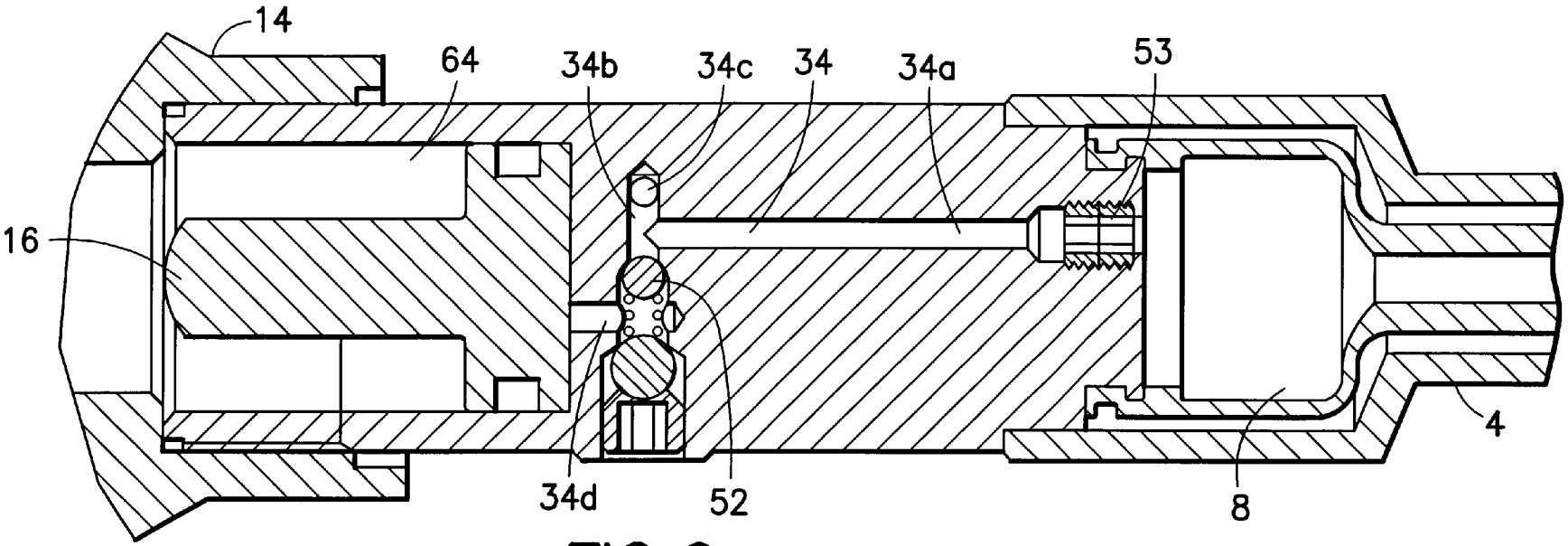
FIG. 6 is a cross sectional view of the tool shown in FIG. 4 taken along line 6—6.

The supply conduit 42 is in communication with the pump 24 and has the check valve 54 therein. As seen in FIGS. 3 and 5, the supply conduit 43 extends between the supply conduit 42 and the supply conduit 44. The supply conduit 43 has a check valve 60 therein. As seen in FIGS. 4, 5 and 2, the supply conduit 44 extends to the conduit 45 which, in turn, extends to the conduit 47. The conduit 47 is in communication with the actuator conduit 46. The actuator conduit 46 has an enlarged portion which forms a receiving area for a mechanical actuator assembly 66.

As seen best in FIG. 2, return conduit 38 extends from the conduit 47 to the relief valve 26. A check valve 56 is located in the return conduit 39. Relief valve 26 automatically temporarily opens when excessive hydraulic fluid pressure is present in the conduit system; such as about 9000 psi for example. The hydraulic fluid can flow through the relief valve 26 back to the reservoir 8 until the pressure drops; at which point the relief valve closes again. Return conduit 39 extends from the ram hydraulic chamber 64 of the cylinder body 14 to the conduit 47.

As seen best in FIG. 5, return conduit 40 extends from the release valve 32 back to the reservoir 8. The release valve 32 comprises a plunger 138 and a check valve 110 in communication with the channel 44. When the plunger 138 is depressed, the check valve 110 is opened such that hydraulic fluid can flow out of the ram hydraulic chamber 64 and out of the actuator conduit 46 through the channels 47, 45, 44 and 40 back to the reservoir 8.

Although the supply and return conduit systems have been described in detail above, in alternate embodiments any suitable type of conduit system could be provided in the body 10 of the tool.

As seen in FIGS. 2 and 5, the handle 6 has a trigger system 140 for moving the plunger 138. The trigger system 140 generally comprises a trigger 142, a connecting rod 144, and an actuator 146. The trigger 142 is pivotably connected to the handle 6. The actuator 146 is also pivotably connected to the handle 6. The connecting rod 144 is connected between the trigger 142 and the actuator 146. In a preferred embodiment, the trigger system 140 comprises a spring (not shown) which biases the system in a deactuated position as shown in FIGS. 2 and 5.

A user can depress the trigger 142 to move the connecting rod 144 which, in turn, moves the bottom end 148 of the actuator 146 to a position directly above the plunger 138. When the handle 6 is moved towards the handle 4, the bottom end 148 of the actuator 146 depresses the plunger 138 to move the check valve 110 into an open position. This allows hydraulic fluid to flow out of the conduit 44 and into the conduit 40, and back to the reservoir 8. When the trigger 142 is released by the user, the actuator 146 is disengaged from the plunger 138. The check valve 110 returns back to its closed position moving the plunger 138 back to its outward position. However, in alternate embodiments, any suitable type of release system or system for actuating the release system could be provided.

Figure 2A:
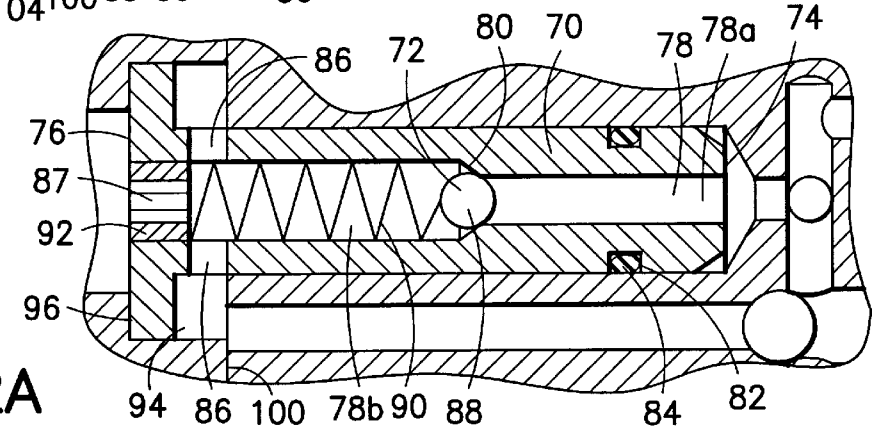
FIG. 2A is an enlarged cross sectional view of a portion of the tool shown in FIG. 2.

Referring also to FIG. 2A, the mechanical actuator assembly 66 generally comprises a housing member 70 and a bypass valve 72. The housing member 70 has a rear end 74, a front end 76, and a conduit channel 78 therebetween. The conduit channel 78 has a first section 78*a* and a second section 78*b*. The first section 78*a* has a smaller cross sectional size than the second section 78*b*. Thus, a valve seat 80 is provided at the junction between the first section 78*a* and the second section 78*b*. The housing member 70 has an annular recess 82 with an O-ring seal 84 therein. In this embodiment, the housing member 70 has a general T shape. The housing member 70 also comprises apertures or holes 86 extending from the conduit channel 78 to a lateral side of the housing member at a location behind the enlarged head at the front end 76. In alternate embodiments, the housing member could have any suitable shape. The conduit channel in the housing member could also have any suitable type of shape or configuration.

The bypass valve 72 generally comprises a ball 88 and a spring 90. In this embodiment, the spring 90 is a coil spring. However, in alternate embodiments, any suitable type of spring could be provided. In addition, the valve could have a movable closure member which does not have a ball shape, and/or any suitable biasing or valve opening/closing system could be provided. The bypass valve 72 is located in the second section 78*b* of the conduit channel. A valve retainer 92 is fixedly located in the front entrance to the second section 78*b*. An end of the spring 90 is located against the valve retainer 92. The opposite end of the spring 90 is located against the ball 88. The ball 88 is biased by the spring 90 towards the valve seat 80.

When the ball 88 is located against the valve seat 80 the passage between the first and second sections 78*a* and 78*b* is closed. The rear end 74 of the housing member and a the rear end of the ball 88 at the first section 78*a* form a first relatively small hydraulic fluid pushing surface. When the hydraulic pressure in the actuator channel 46 is sufficiently high, the pressure can compress the spring 90 to move the ball 88 away from the valve seat 80. When the bypass valve is opened in this type of situation, hydraulic fluid can flow through the conduit channel 78 and out the holes 86 and 87. In alternate embodiments, any suitable type of bypass valve can be provided in the mechanical actuator assembly.

The rear end of the ram 16 comprises a pocket 94. A surface 96 of the rear end at the pocket 94 is adapted to be contacted by the front end 76 of the housing member 70. The ram 16 comprises surfaces 96,98 and 100 at its rear end which form a second relatively larger hydraulic fluid pushing surface. The rear end of the ram 16 also comprises an annular recess 104 having an O-ring seal 106 therein. The rear end of the ram 16 is slidable in the ram hydraulic chamber 64 between its rear position as shown in FIG. 2 and a forward position.

The tool 2 has various different modes of operation. At a start of a crimping or compression operation, a user places an item (such as an electrical connector and a conductor) in the receiving area 17 between the ram 16 and the clamping section 15. The user then pivots the handle 6 back-and-forth relative to the handle 4. This causes the pump 24 to move in and out relative to the frame 28. As the pump 24 moves out, suction or negative pressure is created in the conduit 42. This suction is transmitted through the supply conduit 34 to suck or draw hydraulic fluid from the reservoir 8 into the area of the pump 24. When the pump 24 moves in an inward direction, the check valve 54 closes and hydraulic fluid is pushed through the channels 42–45,47 and into the actuator channel 46.

The tool 2 uses a system to move the ram 16 at two different rates of movement; depending upon hydraulic fluid pressure in the supply conduit system. The two different rates of movement occurs for a same stroke of the pump 24 and a same relative movement of the handles 4,6. In particular, the ram movement system first moves the ram 16 forward relatively quickly. This occurs until resistance is encountered by the ram 16 when the ram makes contact with an article in the compression head. Then the ram 16 moves forward relatively slowly, but with greater force. In both situations, both rates of movement are provided by the same motion of the pump 24.

With the bypass valve 72 closed, the hydraulic fluid pumped into the actuator channel 46 moves the mechanical actuator assembly 66 forward relative to the frame 28. Because of the contact between the front end 96 of the housing member 70 and the surface 96 at the rear end of the ram 16, the ram 16 is pushed forward by the mechanical actuator assembly 66. Thus, the first rate of movement uses hydraulic pressure to move the actuator assembly 66 forward which, in turn, directly push against and moves the ram 16 forward. This provides a relatively fast forward movement of the ram 16. Hydraulic fluid is also sucked or drawn past the check valve 52 and through the section 34*d* of the suction conduit 34 into the ram hydraulic chamber 64 as the ram 16 moves forward. This prevents a vacuum behind the rear end of the ram 16 from forming to thereby prevent such a vacuum from stopping forward movement of the ram 16.

Figure 2B:
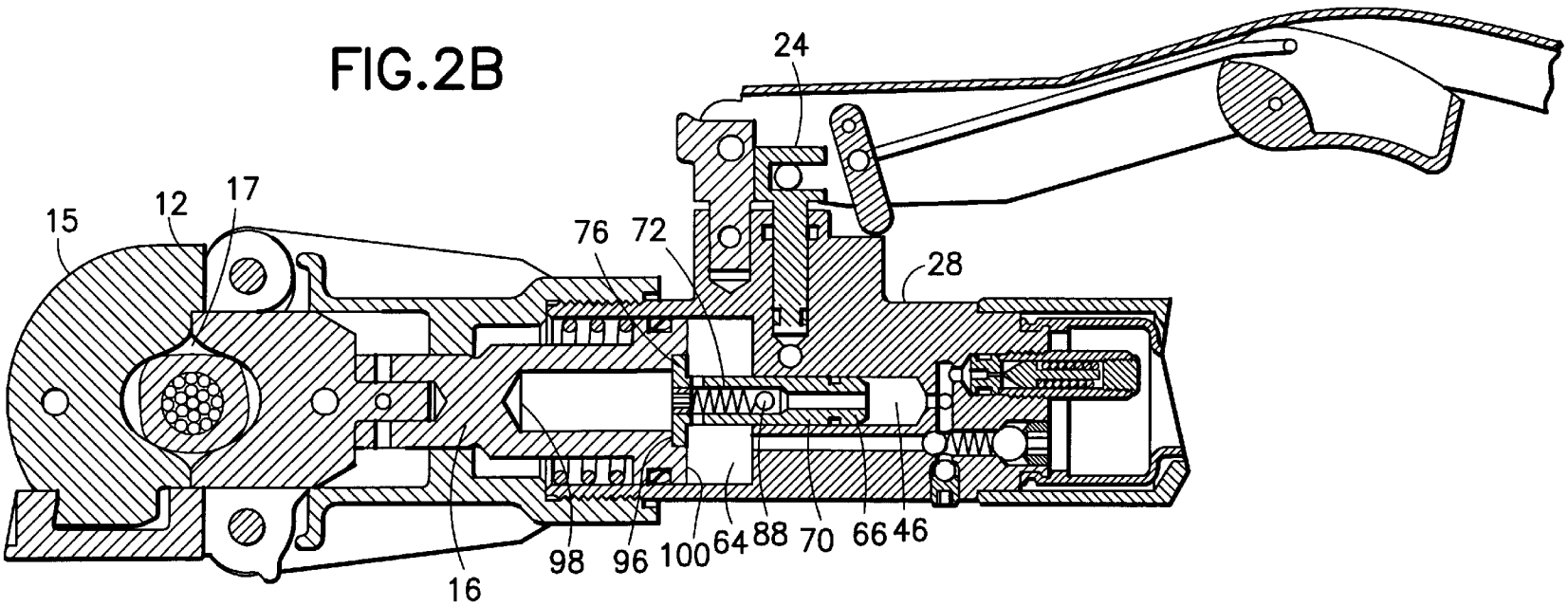
FIG. 2B is a partial cross sectional view of the tool as shown in FIG. 2 with the ram moved forward separately from the mechanical actuator assembly.

Referring also to FIG. 2B, when the ram 16 (or die thereon) clamps the item in the receiving area 17 against the clamping section 15, resistance to further movement of the ram 16 in a forward direction is encountered. With further actuation of the pump 24, hydraulic pressure in the supply conduit system increases. When the hydraulic pressure in the supply conduit system reaches a predetermined level, the bypass valve 72 can automatically open. This results in a change of the operating mode of the tool. When the ram 16 encounters the enlarged resistance to forward movement based upon encountering an article in the compression head 12 (such as a connector to be crimped onto a conductor) the ram movement system automatically switches to a second stage or rate of operation. More specifically, the pump 24 still functions in the same manner of moving in and out, however, the ram 16 is no longer push forward only by the mechanical actuator assembly 66. Instead, the ram 16 is now pushed forward by hydraulic fluid pressure pushing directly against its rear end surface 96,98 and 100, and by the mechanical actuator since the pressure in chamber 46 is slightly greater than chamber 64.

As the pump 24 is moved outward hydraulic fluid is pulled into the area of the pump similar to the first stage of movement. However, in the inward stroke of the pump 24 hydraulic pressure in the conduit 46 and section 78*a* is sufficiently large to push the bypass valve 72 to an open position and allow the hydraulic fluid to flow through the bypass valve and out the holes 86, 87 directly into the ram hydraulic chamber 64 behind the rear end of the ram 16.

The surfaces 96,98 and 100 are much larger than the rear end surface of the housing member 70. Therefore, the ram 16 can generate a much larger forward movement force (F=PA; Force=Pressure×Area). However, resistance to the inward stroke of the pump 24 does not significantly change between the first and second modes of operation. This is because the cross sectional size of the ram hydraulic chamber 64 is much larger than the cross sectional size of the actuator conduit 46. However, the ram 16 moves forward at a slower rate of movement in the second mode of operation than in the first mode of operation since there is considerable volume to fill/compress.

When the pressure in the hydraulic conduit system reaches a predetermined level (such as 9000 psi), the relief valve 26 opens during the inward stroke of the pump 24. Therefore, further forward movement of the ram 16 is automatically stopped. The user can feel a difference in movement of the handle 16 and also detects an audible pop. With these occurrences, the user can thereby recognize when the relief valve 26 opens, and can thus recognize that compression or crimping of the connector has completed. The user can then actuate the trigger system 140 to move the release valve 32 to an open position and the spring 103 can bias the ram 16 back to its rear position. Hydraulic fluid in the ram hydraulic chamber 64 can flow back to the reservoir 8 through the channels 39,47,45,44 and 40.

One of the features of the present invention is in regard to the mechanical actuator assembly 66. As noted above, the mechanical actuator assembly 66 comprises a channel in its housing member and a bypass valve which permits selective flow of fluid through the assembly. Because the bypass valve is located inside the housing member 70, this provides additional space in the frame 28 that otherwise would need to be occupied by a separate bypass valve; as in the U.S. Pat. No. 5,979,215. Thus, the present invention provides a combined mechanical actuator and bypass valve in a single assembly which takes up less space than in the prior art. Because the mechanical actuator assembly 66 takes up less space than in the prior art, the frame 28 can be made smaller. This can reduce the weight of the tool. This also simplifies or reduces the number of conduits that need to be provided in the conduit system. This can reduce the cost of manufacturing the frame 28.

This assembly of a combined mechanical actuator and bypass valve as a single subassembly component also provides another feature. The bypass valve can be adjusted external to the tool as a subassembly. This can allow for a much more precise and relatively easy adjustment of the bypass valve than in the prior art.

Another feature of the present invention is in regard to the hydraulic circuitry or conduit system. In the U.S. Pat. No. 5,979,215 the tool has two suction conduits (104,106) and two check valves (128, 136); one for each suction conduit. The present invention, on the other hand, can have a single suction conduit 34 from the reservoir 8 and check valves 52, 54 at different sections of the single suction conduit. This permits the use of one intake filter 53 at the reservoir end of the tool.

Features of the present invention could be incorporated into a battery operated hydraulic compression tool, such as the BATOOL™ series of battery operated tools sold by FCI USA, Inc. Features of the present invention could include the mechanical actuator assembly not being directly mounted to the pump body. For example, the mechanical actuator assembly 66 could be coaxially mounted in a spring holder for holding the compression spring 103. The spring 103 could be located inside the ram coaxially arranged between the ram and the spring holder. The mechanical actuator assembly 66 could be slidably plugged into a receiving area in a front end of the spring holder. The spring holder could be stationarily mounted to the pump body, such as by threads. The mechanical actuator assembly 66 could be movably mounted inside the spring holder to extend out a front end of the spring holder. The spring holder could have a fluid conduit which connects the conduit channel 78 to the conduit system in the pump body. Such an arrangement could reduce the size of the tool by reducing the length of the tool at the area of the ram/spring-holder/mechanical-actuator-assembly. In alternate embodiments, the mechanical actuator assembly 66 could be used with any other suitable type of components, or be modified to be used with any other suitable types of hydraulic compression tool components.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a hydraulic tool having a frame, a hydraulic fluid reservoir on the frame, a ram movably connected to the frame, the ram having a rear end hydraulic fluid contact surface, a conduit system in the frame between the reservoir and the ram, a pump provided in the conduit system, a mechanical actuator provided in the conduit system for contacting the ram, and a bypass valve in the conduit system between a rear end of the ram and a channel of the conduit system to the rear end of the mechanical actuator, wherein the conduit system is adapted to conduit fluid from the pump against both the rear end of the ram and a rear end of the mechanical actuator, the improvement comprising:

the bypass valve being located, at least partially, in a housing member of the mechanical actuator.

2. A hydraulic tool as in claim 1 wherein the housing member comprises a conduit channel extending into the housing member from a rear end of the housing member.

3. A hydraulic tool as in claim 2 wherein the conduit channel comprises a first section with a first cross sectional size and a second section with a second relatively larger cross sectional size, and the housing member forms a valve seat between the first and second sections.

4. A hydraulic tool as in claim 3 wherein the bypass valve comprises a ball and a spring located in the second section, and wherein the ball is biased by the spring against the valve seat to close a passage between the first and second sections.

5. A hydraulic tool as in claim 2 wherein the bypass valve comprises a ball and a coil spring.

6. A hydraulic tool as in claim 2 wherein the housing member comprises a front end with an aperture from the conduit channel through the housing member to a lateral side of the housing member.

7. A hydraulic tool as in claim 6 wherein a hole extends through the front end from the conduit channel.

8. A hydraulic tool as in claim 2 wherein the housing member has a general T shape.

9. A hydraulic tool as in claim 1 wherein the conduit system comprises a single hydraulic fluid suction line extending from the reservoir, wherein hydraulic fluid from the reservoir is deliverable through the single suction line directly to the ram through a check valve and, to the mechanical actuator through the pump.

10. A hydraulic tool as in claim 9 wherein the tool further comprises a single filter, and wherein the filter is located in the suction line.

11. A hydraulic compression tool mechanical actuator comprising:

a housing member having a front end adapted to push against a hydraulic compression tool movable ram, a rear end hydraulic fluid pushing surface, and a hydraulic fluid conduit channel through the housing member, wherein the housing member comprises a front end with a lateral aperture from the conduit channel through the housing member to a lateral side of the housing member; and a bypass valve member connected to the housing member at the conduit channel.

12. A hydraulic compression tool mechanical actuator as in claim 11 wherein the conduit channel extends into the housing member from a rear end of the housing member.

13. A hydraulic compression tool mechanical actuator as in claim 11 wherein the conduit channel comprises a first section with a first cross sectional size and a second section with a second relatively larger cross sectional size, and the housing member forms a valve seat between the first and second sections.

14. A hydraulic compression tool mechanical actuator as in claim 11 wherein the bypass valve comprises a ball and a spring located in the second section, and wherein the ball is biased by the spring against the valve seat to close a passage between the first and second sections.

15. A hydraulic compression tool mechanical actuator as in claim 11 wherein the bypass valve comprises a ball and a coil spring.

16. A hydraulic compression tool mechanical actuator as in claim 11 wherein a hole extends through the front end from the conduit channel.

17. A hydraulic compression tool mechanical actuator as in claim 11 wherein the housing member has a general T shape.

18. In a hydraulic compression tool having a frame, a hydraulic fluid reservoir on the frame, a ram movably connected to the frame, the ram having a rear end hydraulic fluid contact surface, a conduit system in the frame between the reservoir and the ram, a pump provided in the conduit system, and a mechanical actuator provided in the conduit system for contacting the ram, wherein the conduit system is adapted to conduit fluid from the pump against both the ram and the mechanical actuator, the improvement comprising:

the conduit system comprises a single hydraulic fluid suction line extending from the reservoir, wherein hydraulic fluid from the reservoir is deliverable through the single suction line directly to the ram through a check valve and, to the mechanical actuator through the pump.

19. A hydraulic compression tool as in claim 18 further comprising a single hydraulic fluid filter, the filter being located in the single suction line.

20. A hydraulic compression tool as in claim 18 wherein the mechanical actuator comprises a housing member having a conduit channel therethrough, and a bypass valve located in the conduit channel.

21. A method of manufacturing a hydraulic compression tool comprising steps of:

providing a mechanical actuator assembly, the mechanical actuator assembly having a housing member with a hydraulic fluid channel therethrough, and a bypass valve located in the housing member at the channel;

connecting the mechanical actuator assembly to a frame of the tool, the frame comprising a conduit system, the housing member of the mechanical actuator assembly being slidingly located in a portion of the conduit system; and connecting a ram to the frame, the ram being movable on the frame and being adapted to be directly contacted by the mechanical actuator assembly, wherein the ram is movable relative to the housing member of the mechanical actuator assembly, wherein the step of providing a mechanical actuator assembly comprises forming a laterally extending hole through the housing member from the hydraulic fluid channel to a lateral side of the housing member.

22. A method as in claim 21 wherein the step of providing a mechanical actuator assembly comprises locating a ball and a spring in the fluid channel, the spring biasing the ball against a valve seat of the housing member to form the bypass valve.

23. A method as in claim 21 further comprising providing the conduit system in the frame with a single suction line from a hydraulic fluid reservoir inside the frame.

24. A method of advancing a ram in a hydraulic compression tool comprising steps of:

actuating a pump of the tool to move the ram relative to a frame of the tool at a first rate of movement comprising pushing hydraulic fluid against a first pushing surface of a mechanical actuator to push the ram forward, the mechanical actuator being located against the ram;

actuating the pump to move the ram relative to the frame at a second slower rate of movement comprising pushing hydraulic fluid against a second larger pushing surface of the ram to push the ram forward; and sucking hydraulic fluid through a single suction line from a fluid reservoir of the tool directly to the pump through a first check valve and, sucking hydraulic fluid through the single suction line from the fluid reservoir of the tool directly to the second larger pushing surface of the ram through a second check valve while the pump is pumping hydraulic fluid, wherein the mechanical actuator has a conduit channel with a bypass valve therein, and wherein the step of actuating the pump of the tool to move the ram relative to the frame at the second lower rate of movement comprises hydraulic fluid passing through the conduit channel and the bypass valve of the mechanical actuator to the second larger pushing surface of the ram.

* * * * *